US005651335A

United States Patent [19]

Elendt et al.

[11] Patent Number: 5,651,335

[45] Date of Patent: Jul. 29, 1997

[54] VALVE TAPPET

[75] Inventors: Harald Elendt, Wilhelmsdorf; Gerald Fischer, Höchstadt/Aisch; Gerhard Maas, Herzogenaurach; Christof Faria, Röttenbach; Michael Haas, Weisendorf; Hermann Wiehl, Herzogenaurach, all of Germany

[73] Assignee: Ina Wälzlager Schaeffler KG, Herzogenaurach, Germany

[21] Appl. No.: 535,264

[22] PCT Filed: Apr. 7, 1994

[86] PCT No.: PCT/EP94/01078

§ 371 Date: Jan. 11, 1996

§ 102(e) Date: Jan. 11, 1996

[87] PCT Pub. No.: WO94/25741

PCT Pub. Date: Nov. 10, 1994

[30] Foreign Application Priority Data

May 4, 1993 [DE] Germany ..... 43 14 619.8

[51] Int. Cl.[6] ..... F01L 13/00; F01L 1/14

[52] U.S. Cl. ..... 123/90.16; 123/90.5; 123/90.55

[58] Field of Search ..... 123/90.15, 90.16, 123/90.17, 90.48, 90.49, 90.5, 90.55

[56] References Cited

U.S. PATENT DOCUMENTS

| | | | |
|---|---|---|---|
| 5,090,364 | 2/1992 | McCarroll et al. | 123/90.16 |
| 5,287,830 | 2/1994 | Dopson et al. | 123/90.16 |
| 5,361,733 | 11/1994 | Spath et al. | 123/90.16 |

FOREIGN PATENT DOCUMENTS

| | | |
|---|---|---|
| 42 06 166 | 9/1992 | Germany . |
| 93 06 685 | 6/1993 | Germany . |
| WO 91 12413 | 8/1991 | WIPO . |

*Primary Examiner*—Weilun Lo
*Attorney, Agent, or Firm*—Henry M. Feiereisen

[57] ABSTRACT

A two-part tappet is designed to be adaptable to different cam contours. Radial bores (11, 12) are provided in the base sections (2, 3) for receiving at least one radially shiftable piston (13) for coupling the sections (2, 3).

23 Claims, 6 Drawing Sheets

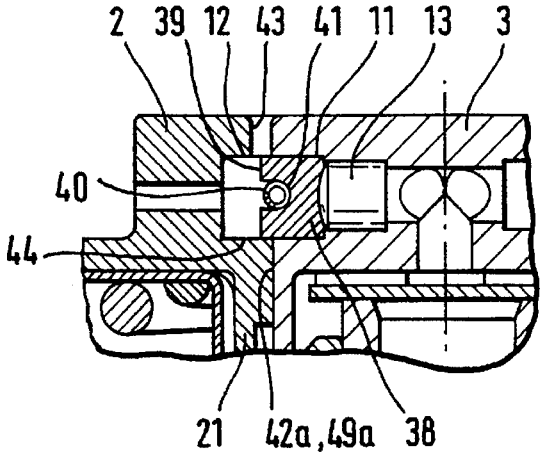
Fig. 5
Fig. 6
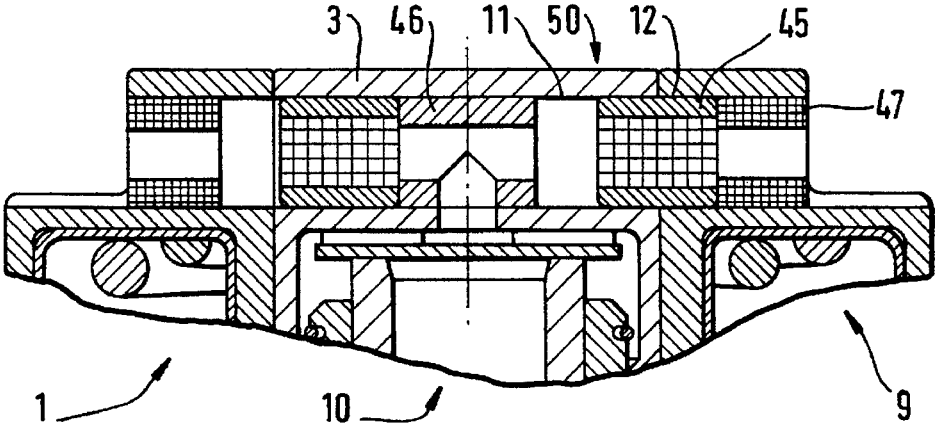
Fig. 7
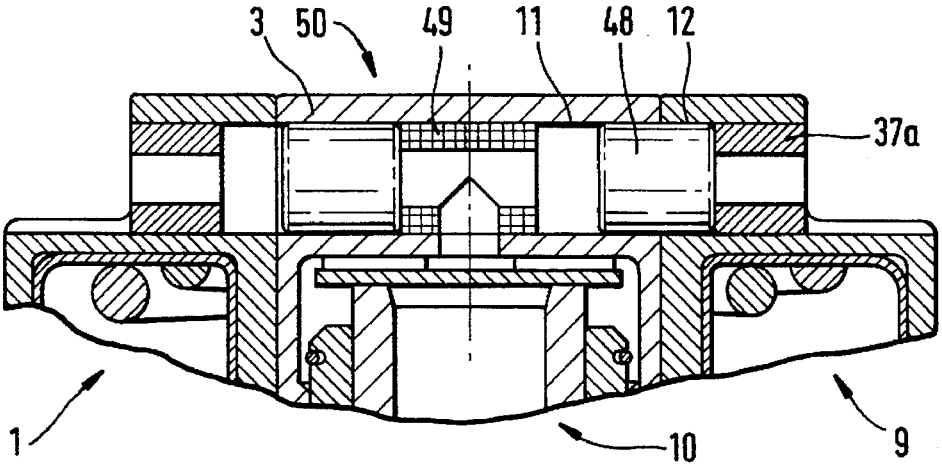

VALVE TAPPET

BACKGROUND OF THE INVENTION

The invention refers to a tappet for a valve actuating mechanism of an internal combustion engine having a circular ring shaped base section and a circular base section which are arranged concentrically to each other and respectively acted upon by cams of different strokes, with a central cam of small stroke acting upon the circular base section and at least one adjacent cam of greater stroke acting upon the circular ring shaped base section, wherein the tappet is guided in a bore of a cylinder head by a hollow cylindrical jacket that is connected to the circular ring shaped base section while the circular base section receives at its cam-distant end face a guide sleeve accommodating a clearance compensation element, and wherein the units which comprise the two base sections are slideable relative to each other and engageable by radially displaceable coupling means.

German Pat. No. DE-A-42 06 166 discloses a tappet of this type which includes a two-part housing with a base acted upon by at least two cams of different stroke pattern. Coupling of both housing parts is effected by pistons that act in radial direction and are provided with pins. In disengaged position, the outer housing part executes an idle stroke. The inner housing part follows the contour of the inner cam. The valve executes a smaller stroke. In case the tappet of this type should act hydraulically in order to compensate a possibly existing valve clearance, it is not possible or only at great difficulty to effect the oil supply to the hydraulic element. In this case, a second, separate oil supply conduit that extends from the cup-shaped jacket to the piston and to the clearance compensation element would be required in combination with separate control conduits within the cylinder head.

A further drawback of the tappet known from the above-mentioned publication is its lack of disclosing for both locking elements a limitation of axial displacement or a safety mechanism to safeguard a loss thereof. Moreover, as the base is of flat configuration, the external cam has only a limited support on the base for actuating the outer housing part. In order to ensure the area that is required during the migration of the cam on the base of the tappet, and to realize the desired valve lift diagrams, a base of cylindrical configuration in the camshaft direction would be desirable.

SUMMARY OF THE INVENTION

The invention is thus based upon the object to create a tappet of the above-stated type, obviating the aforestated drawbacks and effecting in particular a simple and reliable coupling mechanism with joint control of the hydraulic element at the same time, while assuring the required valve lift diagrams.

In accordance with the invention, this object is attained by providing the circular base section and the circular ring shaped base section with radially oriented bores that are in alignment in a base circle phase of the cams and receive as coupling means at least one piston which is shiftable by a pressure medium in opposition to a spring force, and by configuring the piston for displacement in radial direction in the event of engagement of both units such that it bridges with its outer peripheral surface an annular partition plane which is defined between both units and extends in axial direction. This configuration effects a simple coupling mechanism for both elements. As the bases of these elements are of cylindrical configuration as viewed in direction of the camshaft, the desired valve lift diagrams are assured in a simple fashion because now the base exhibits the support surface required for the cams. The control and operation of the tappet should be effected in dependence of such operational conditions like engine speed, load and temperature. In the lower speed and load range, at least one intake valve is switched over to a valve lift diagram with small lift and small opening angle, or is completely out of action. Thus, the mixture formation and combustion is positively affected by the forming swirl in the combustion chamber. The higher intake velocities due to the smaller opening cross sections can further result in an improved carburation and evaporation of the mixture. These effects positively affect the fuel consumption and the exhaust emission. It is also conceivable and within the scope of this invention to provide a solution by which the configuration of the cam contour and of the cooperating tappet effects, in the mid-speed range, a valve lift diagram for high engine torque, and at high speeds, a valve lift diagram for high engine performance by switching the tappet over. Ultimately, these mentioned measures optimize the efficiency and performance and decrease the exhaust emission of the internal combustion engine.

Preferably, hydraulic oil is used as pressure medium, wherein a common feed conduit, which extends from an inlet bore through the jacket, is provided for supply of the pressure medium to a central oil reservoir of the clearance compensation element and to act upon the piston. This measure permits utilization of hydraulic oil that is used for lubrication of the internal combustion engine, at the same time for charging the hydraulic clearance compensation element. Only one oil pump is required whose flow rate and pump capacity can be adjusted—if necessary—to increased demand. Conceivable are however also other pressure mediums such as braking fluid or the like; however, in this case a separate control of the mechanism effecting the engagement of the units is required. As a common feed conduit is provided for the pressure medium to the mechanism and to the clearance compensation element in the tappet, the manufacturing costs are minimized.

It is possible to utilize the one control conduit for supply of pressure medium to the hydraulically acting tappet that anyway exists in the cylinder head. The coupling of the circular ring shaped base section with the circular base section is realized, for example, at a crankshaft speed of 2,500 rpm. Up to this speed, a throttle valve is operated in the supply gallery for pressure medium for the tappet in the cylinder head. This throttle valve maintains a throttling of the pressure of hydraulic oil in the gallery up to a particular value, like 0.5 bar. Up to this pressure, the pistons are retained by spring force in their bore within the circular base section, and the two-part tappet is released.

When the above-stated speed is exceeded, the throttle valve opens and relieves the normally prevalent pressure of the hydraulic oil. The oil pressure that is effective up to this point is dimensioned in such a manner that the functionality of the hydraulic clearance compensation element in the tappet as well as the engine lubrication are ensured. The now applied pressure of hydraulic oil is utilized to displace the respective piston in opposition to the spring force in radial direction such that the piston bridges with its outer peripheral surface the ring-shaped axial partition plane between both units and remains in this position. In this situation, both elements are connected in form-fitting manner, with the provided outer pair of cams acting with its great stroke upon the valve. In case the speed drops below the above-stated switch point, the oil pressure is again throttled and the tappet disengaged.

According to another feature of the present invention, a sleeve-like concentric prolongation extends from the circular ring shaped base section in a direction facing away from the cams for receiving the guide sleeve of the circular base section in a bore thereof. Suitably an annular space which extends in radial direction between the concentric prolongation and the jacket receives an annular sheet metal part of inverted U-shaped configuration, as viewed in cross section, that has a bottom for confining a first oil reservoir in direction to the circular ring shaped base section. The sheet metal part bears with its sides against inner peripheral surfaces of the jacket and the concentric prolongation in an oiltight and airtight manner. Provided between the inner peripheral surface of the jacket and the adjoining side, as well as between the inner peripheral surface of the prolongation and the adjoining side of the U-shaped sheet metal part is a grooved cross section for pressure medium that extends from the inlet bore into the first oil reservoir and from there via at least one bore, which intersects the concentric prolongation and the guide sleeve, to the central oil reservoir of the clearance compensation element and to the pistons. The sheet metal part, described herein and conceivably substituted by other materials such as plastics, creates an inexpensive and simple common oil feed conduit for the pistons and to the hydraulic element. The relatively low-lying induction point guarantees with great certainty that no air is aspirated or pressed into the central oil reservoir or for acting upon the pistons. This air or forming foam leads in the extreme case to malfunction of the tappet, in particular, during short distance driving of the internal combustion engine. Moreover, the configuration in accordance with the present invention, as described herein, eliminates a need for a separate oil conduit in the cylinder head and in the tappet, i.e. the use of conventional cylinder heads is possible.

In accordance with yet another feature of the present invention, an inner piston, which is supported in an outer piston of the clearance compensation element and has an end face facing the cams, is provided with a plate-shaped insert which, one the one hand, is arranged between the end face and at least one opening for transfer of pressure medium into the central oil reservoir and, on the other hand, there is arranged between the plate-shaped insert and the end face, at least one radial channel for admission of pressure medium acting upon the piston. There is no need to secure this plate-shaped insert because it is held by the elements being pushed together. This configuration divides the oil flow to the piston and to the clearance compensation element in a simple manner. It would, however, also be conceivable to use fastened elements, or to suitably configure the tappet interior itself.

Preferably, the spring force is effected by at least one tension spring which is connected to each piston and has another end secured to a pin that is arranged centrally in the circular base section, with the pistons being held by the tension spring in the disengaged position of the units in the bore of the circular base section. For this, it is possible to utilize existing, standard construction elements. It is also conceivable and provided to utilize several assembled tension springs. However, the scope of the invention is not limited to the tension springs as described herein. Conceivable are a number of variations with elements that exhibit elastic properties.

In accordance with another feature of the present invention, stop means are provided in the bores of the circular ring-shaped base section for limiting a displacement of the pistons in radial direction. This configuration effects in a simple manner a stop for the pistons. Conceivable are sleeves, however, the stop mechanism may also be realized through upsetting the bore of the circular ring shaped bottom part, or like solutions.

Preferably, the bores in the circular base section are arranged in a star shape, with each bore receiving a piston, wherein each piston is preceded in radial direction by a ring segment as coupler, with the ring segments being acted upon their outer peripheral surface by a jointly circumscribing spring element that acts radially inwards. The spring element may be formed by at least one tubular spring which is secured in place in an annular groove extending in the outer peripheral surface of the ring segments. The annular grooves are easy to manufacture. Moreover, this configuration does not require a safety mechanism to prevent rotation between the inner element and the outer element. Also, through this configuration, the centrally supported pin, can be omitted. The multitude of pistons reduces the surface pressure acting upon the pistons as well as upon the ring segments in case of engagement, i.e. they can be configured of smaller dimensions.

In accordance with another feature of the present invention, the bore of the concentric prolongation exhibits at least in the region of the ring segments, which project from the bores of the circular base section in disengaged position, a diametrical enlargement that forms a lower edge for providing a stop for the ring segments. This diametrical enlargement eliminates the need for other means to limit an axial displacement of both elements relative to each other. Also conceivable in the described variations or other variations is a separate control of the pistons, whereby the pressure effecting the engagement is variable without adversely affecting the functionality of the clearance compensation element. Hydraulic oil possibly contained in the diametrical enlargement can be forced out via the radial bores in the circular ring shaped base section.

In accordance with an additional embodiment according to the invention, at least one permanent-magnetic piston is provided which is arranged in the disengaged position in the bore of the circular base section and in case of engagement of the two units is shiftable in radial direction in opposition to its magnetic force by hydraulic oil in direction of a stop sleeve which is supported centrally in the bore of the circular base section, there being arranged in the respective bore of the circular ring shaped base section, a permanent-magnetic body which exerts a repulsive force with respect to the piston. Alternatively, at least one ferromagnetic, non-magnetizable piston may be provided which is arranged in the disengaged position in the bore of the circular base section and, which in the event of engagement of the two units, is shiftable in radial direction by hydraulic oil in opposition to the magnetic force of a permanent magnet which is centrally supported in the bore of the circular base section. These magnetic means eliminate the use of the spring mechanism for coupling purposes. The magnetic force of the permanent magnet is suitably dimensioned to last beyond the service life of the tappet. In order to prevent ferromagnetic particles, possibly present in the hydraulic oil, from adhering to the permanent magnets, suitable measures which are not described in more detail, may be provided to keep these particles away from the coupling mechanism such as for example filtering means, magnetic separation means, or other means utilizing gravitational or centrifugal forces.

According to another feature of the present invention, stop means are provided for limiting a relative displacement in axial direction of the two units. Preferably, the stop means are arranged in a region of an outer peripheral surface of the guide sleeve situated near one cam-proximate end face of the circular base section, with the stop means being formed by rolling elements which are press-fitted in complementary recesses of the outer peripheral surface of the guide sleeve. These stop means limit the relative movement of both elements in disengaged position during the base circle phase of the cams relative to each other. Moreover, the stop means prevent during a transport a dismantling of the tappet components. It is also conceivable and within the scope of the present invention to provide further stop means such as a ring fitted in a groove of the outer peripheral surface of the guide sleeve, an upsetting or similar solutions, or also a different position of the stop means than the one described herein. The measures described herein effect an inner force flux between the locking elements which decreases the effective force of the compression spring upon the cams of greater stroke and upon a compression spring disposed in the clearance compensation element. The operation of the clearance compensation element is thus ensured through all stroke phases and locking phases.

Suitably, the tappet is guided and secured against rotation in the bore of the cylinder head by a roller needle that is arranged in the jacket thereof and projects radially beyond the jacket. This roller needle, preferably arranged centrally in the jacket, prevents in a simple manner a rotation of the tappet in its bore within the cylinder head. This safety mechanism to prevent rotation is necessary in view of the cylindrical configuration of the bases of both elements in direction of the camshaft. In case the bases do not exhibit a cylindrical configuration but a flat surface configuration, this safety mechanism to prevent rotation may possibly be omitted.

A simple safety mechanism to prevent rotation of both elements relative to each other may be effected by forming an outer peripheral surface of the guide sleeve and the bore of the concentric prolongation with complementary flattened areas. Instead of the described flattened areas, other safety mechanisms such as feather keys or the like that engage a groove, may be provided. At the same time, the flattened areas decrease the travel of the pistons in radial direction so long as the pistons are arranged at the circumferential section of the flattened areas.

According to another feature of the present invention, at least one compression spring, which circumscribes the guide sleeve and acts in axial direction, is arranged in the annular space between the bottom of the U-shaped sheet metal part and a further sheet metal part extending from a cam-distant region of the guide sleeve in radial direction. This compression spring maintains the outer ring shaped element in continuous contact against the cams when the elements are disengaged. A complete disengagement of both elements is prevented by the stop means. The force of this compression spring is selected as high as possible in order to maintain the operation of the tappet up to the maximum speed. It is within the scope of the present invention to include further spring elements, also such which do not circumscribe the guide sleeve but are arranged for example after the fashion of planets within the annular space around the guide sleeve.

According to an alternative variation of a safety mechanism which prevents rotation of both base sections relative to each other and at the same time effects a stroke limitation. An outer peripheral surface of the guide sleeve exhibits a flattened area in direction of the base. Extending into this flattened area from the bore of the circular ring shaped base section is a stop member formed as sleeve. This stop member which bears with its end face against the flattened area effects a simple safety mechanism to prevent rotation of the circular ring shaped base section relative to the circular base section. The circular base section is provided on its cam-side with a collar of a diameter in correspondence to the original guide sleeve so that the circular ring shaped base section together with its sleeve is stopped in cam direction by this collar and its displacement thus limited. At the same time, this configuration effects an inner force flux of the compression spring supported between both elements. This feature is advantageous especially in the context of manufacturing because only the guide sleeve exhibits a flattened area which is easy to produce so that there is no need to flatten the prolongation of the circular ring shaped section in its bore. Thus, the sleeve effects a vertical stop as well as a safety mechanism to prevent rotation and the rolling elements described above can be omitted as vertical stops. Preferably, two such stops situated diametrically opposite each other are provided. Included within the scope of this invention is also a solution in which the locking piston is positioned in the bore of the stop member and is shifted in case of engagement radially inwards by hydraulic means or the force of a spring.

A further, essential advantage of the tappet according to the present invention described herein includes its low weight, in which connection, a lightweight variation with a housing of aluminum or another lightweight material, or with a housing of a composite material is also conceivable, or a variation with a wear-resistant protective layer applied to the jacket or the bases. The weight of the tappet described herein corresponds approximately to conventional, non-switchable tappets. The cup shape results in a small installation height of the tappet. There is thus no need to modify assembly dimensions, for example from an existing camshaft to the crankshaft. It is also conceivable to make the described tappet from a tool steel with the designation X 210 so that a highly wear-resistant tappet with slight distortion during heat treatment is created.

The scope of the invention should not be limited to individual features. It is conceivable and provided to combine various features with stated advantages and disclosed features of the exemplified embodiment.

BRIEF DESCRIPTION OF THE DRAWING

The invention is illustrated in the drawing and is now described in more detail with reference thereto, in which:

FIG. 5 shows the detail Z' in correspondence to the detail Z of FIG. 4, however, with inner spring support via a stop on the ring segment;

FIG. 6 is a partial section of a tappet with magnetic locking mechanism;

FIG. 7 is a further partial section of a tappet with an additional variation with regard to the magnetic locking mechanism;

DETAILED DESCRIPTION OF PREFERRED EMBODIMENTS

Figure 1:
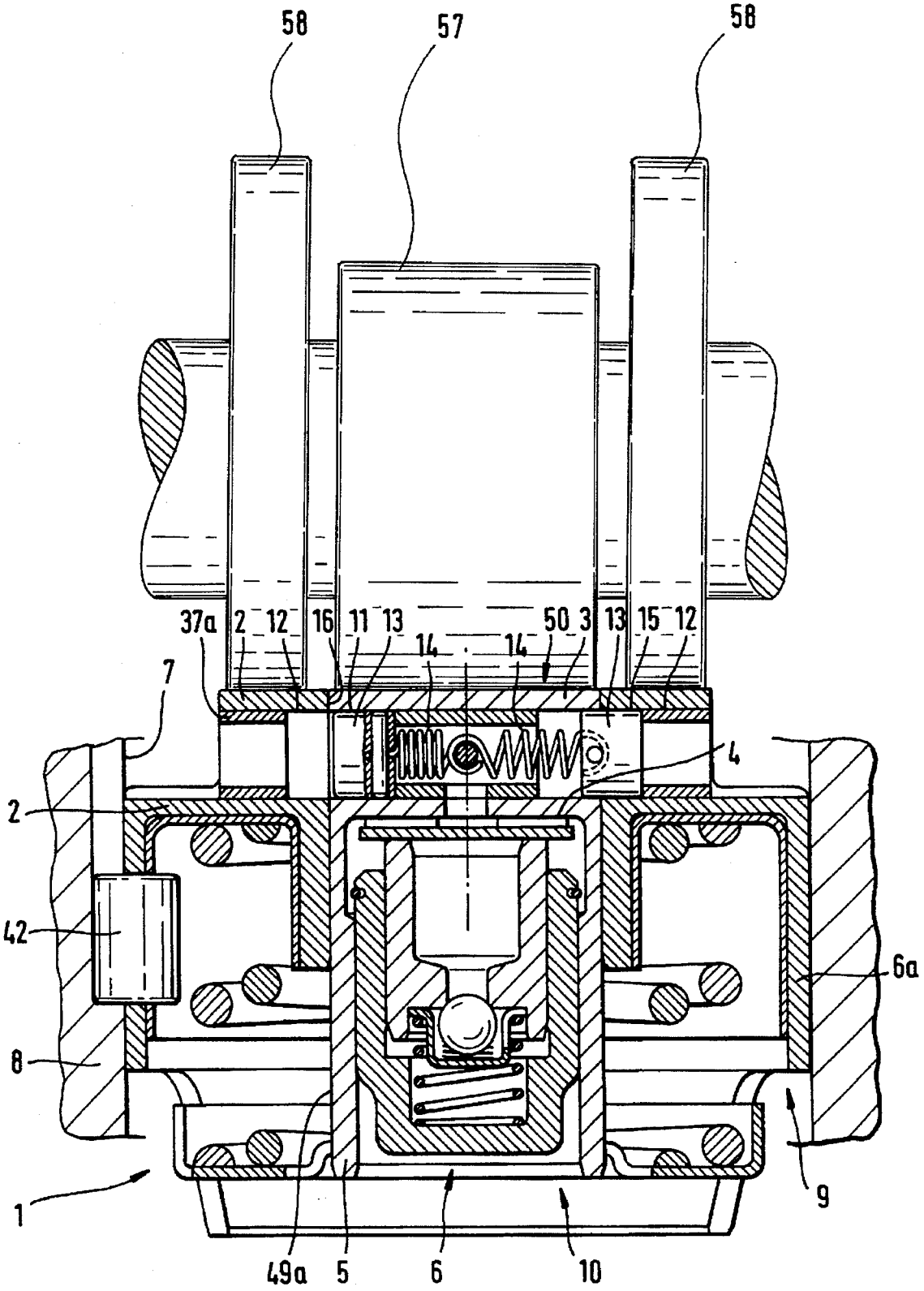
FIG. 1 is a longitudinal section of a tappet according to the invention.

FIG. 1 shows a tappet 1 which includes a first tappet member with a circular ring shaped base section 2 and a circular base section 2, 3. Both base sections are acted upon by cams 57, 58 of a second tappet member with different strokes, with the circular ring shaped base section 2 being acted upon by at least one cam of greater stroke than the circular base section 3. Extending from a cam-distant end face 4 of the circular base section 3 is a concentric guide sleeve 5. Received in the guide sleeve 5 for movement in longitudinal direction is a hydraulically acting clearance compensation element 6. A hollow cylindrical jacket 6*a* connected with the circular ring shaped base section 2 extends likewise in a cam-distant direction and is guided in a bore 7 of a cylinder head 8. The circular ring shaped base section 2 with its jacket 6*a*, and the circular base section 3 with its guide sleeve 5 form separate units 9, 10. Both units 9,10 are configured for displacement relative to each other.

Provided in the circular and circular ring shaped base sections 3, 2 are radial bores 11, 12 which are in alignment in a base circle phase of the cams 57, 58. Two pistons 13 are positioned in the bore 11 of the circular base 3 in the disengaged position of the tappet 1. In case of engagement, the pistons 13 are pushed in opposition to the force of an associated tension spring 14 by hydraulic oil in direction of the bores 12 and bridge with their outer peripheral surface 15 an axial, annular partition plane 16 that is defined between both units 9, 10.

Figure 2:
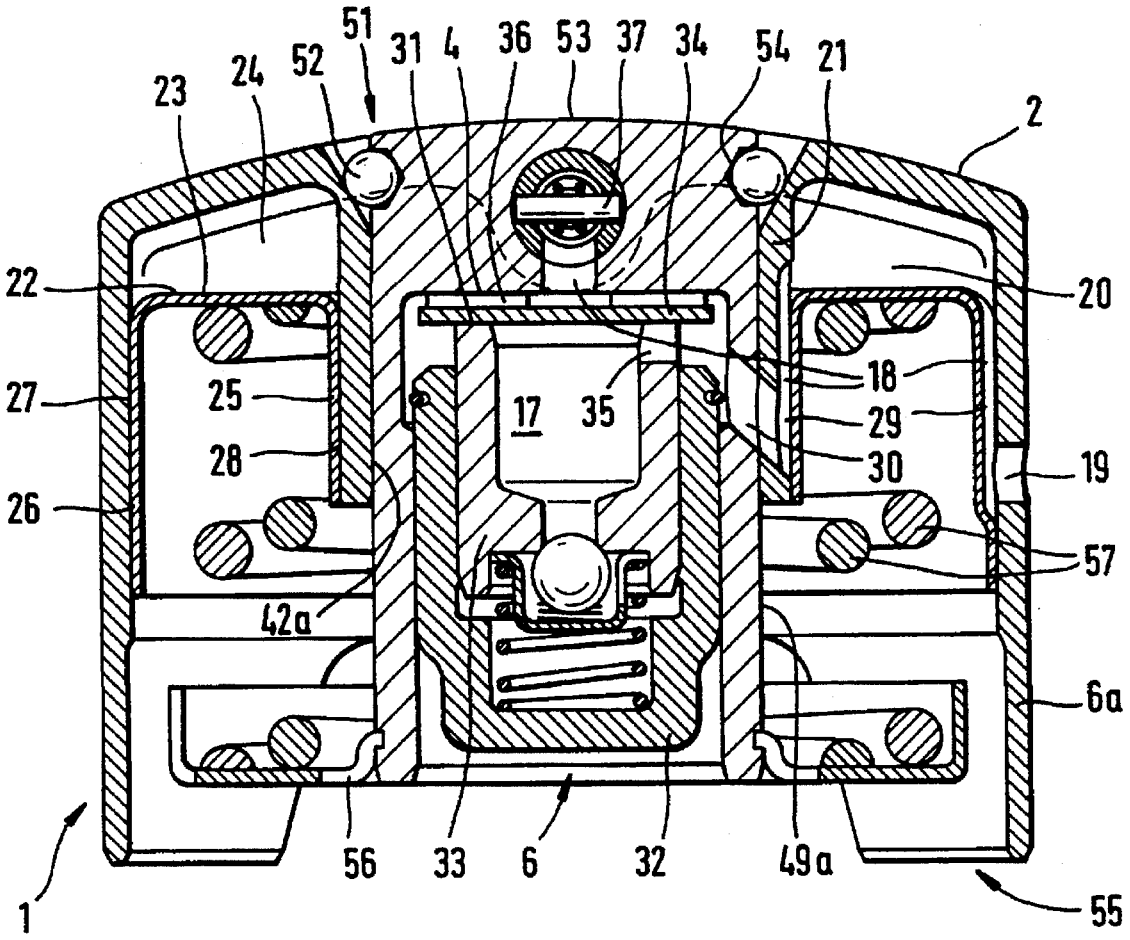
FIG. 2 is a sectional view according to FIG. 1, turned by 90°.

As shown in FIG. 2, only one common supply conduit 18 is provided for supply of hydraulic oil to a central oil reservoir 17 of the clearance compensation element 6 and to act upon the piston 13. The formation of this supply conduit 18 is effected by an annular sheet metal part 22 of inverted U-shaped cross section which is provided in an annular space 20 extending in radial direction between the jacket 6*a* and a concentric prolongation 21 that extends from the circular ring shaped base section 2 in a cam-distant direction. A bottom 23 of the sheet metal part 22 confines an annular oil reservoir 24 in direction towards the circular ring shaped base section 2. The sheet metal part bears with its sides 25, 26 simultaneously against an inner peripheral surface 27 of the jacket 6*a* and against an inner peripheral surface 28 of the concentric prolongation 21 in an oiltight and airtight manner. Provided between these surfaces and sides is a grooved cross section 29 for hydraulic oil. This cross section 29 connects the inlet bore 19 with the first oil reservoir 20, 24 and extends from there via a bore 30 to the central oil reservoir 17 in the clearance compensation element 6 as well as to the pistons 13.

An inner piston 33 is supported in an outer piston 32 of the clearance compensation element 6 and has an end face 31 that faces the cams 57, 58 for receiving a plate-shaped insert 34 to divide the oil flow. Formed between the latter and the end face 31 is at least one opening 35 for the oil transfer into the oil reservoir 17. A further channel 36 is formed between the plate-shaped insert 34 and the end face 4 of the circular base section 3 for conducting hydraulic oil to the pistons 13 which in turn are each connected to a tension spring 14 that is secured at its other end on a pin 37. This pin 37 is supported in the circular base section 3. Further fastening means are conceivable for the tension spring 14; however, these are not referred to herein in more detail. The pistons 13, which are acted upon by pressure medium, are limited in their radial displacement in the bores 11, 12 (see FIG. 1) by stop members 37*a* which are formed as sleeves in the bores 12.

Figure 3:
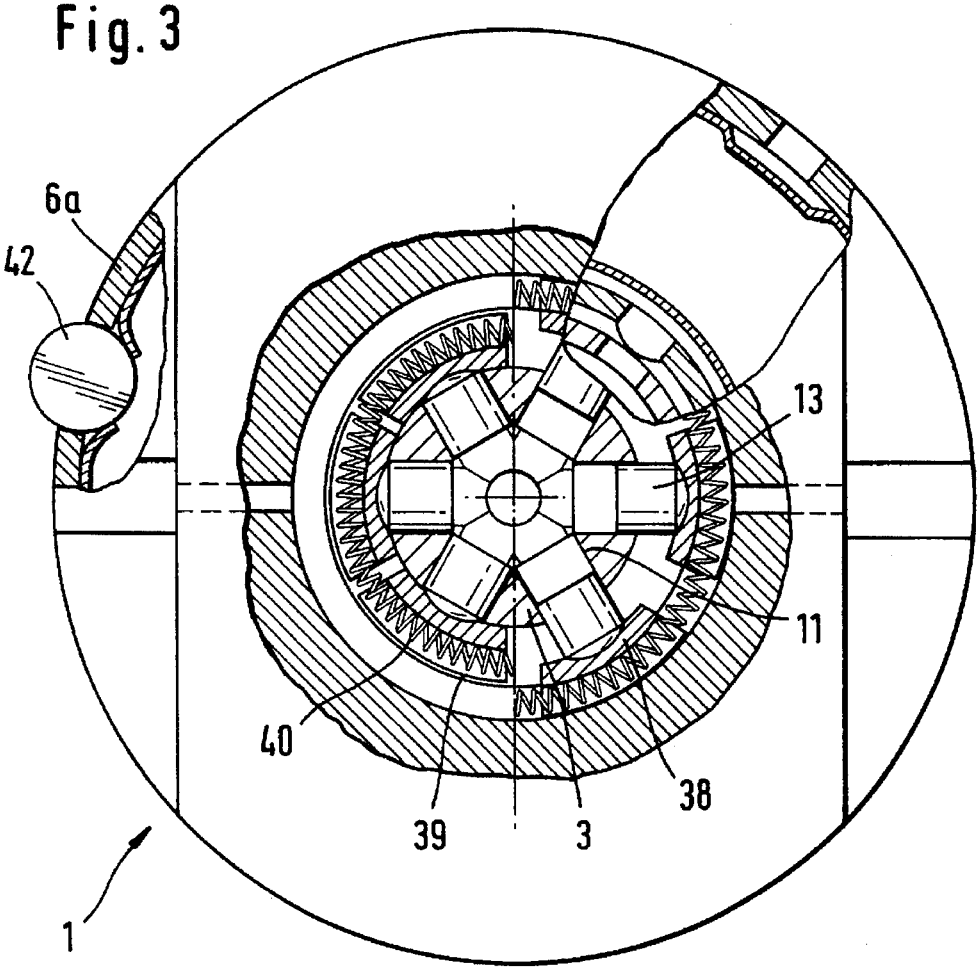
FIG. 3 is a cross section of a tappet with bores arranged in the circular base section.
Figure 4:
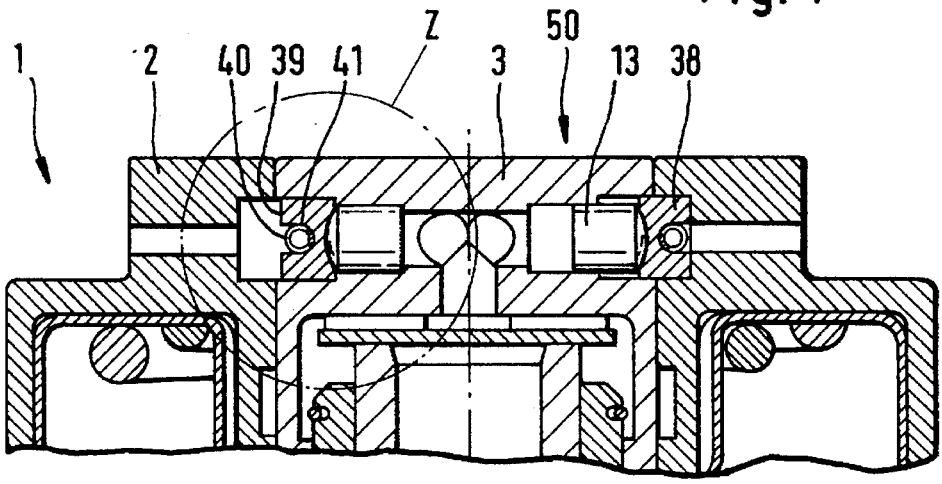
FIG. 4 is a longitudinal section of a tappet according to FIG. 3.

The bores 11 in the circular base section 3 are arranged in a star shape, as shown in FIG. 3 and 4. In accordance with this variation, each piston 13 is preceded in radial direction by a ring segment 38. The ring segments 38 are pushed radially inwards at their outer peripheral surface 39 by a spring element 40 formed as tubular spring. This spring element 40 is retained in an annular groove 41 (see FIG. 4) of the outer peripheral surface 39 of the ring segments 38. The tappet 1 is secured against rotation in its bore 7 within the cylinder head 8 by a roller needle 42 which in this example is arranged centrally in the jacket 6*a* thereof (see also FIG. 1).

As shown in FIG. 5, a bore 42*a* of the concentric prolongation 21 can exhibit a diametrical enlargement 43. A lower edge 44 thereof forms a stop area for the ring segments 38. The diametrical enlargement 43 limits a relative displacement between both units 9, 10.

FIG. 6 shows a configuration according to the present invention of a tappet 1 with a magnetic coupling mechanism, with a permanent-magnetic piston 45 being provided which is arranged in disengaged position in the bore 11 of the circular base section 3. In case of engagement of both units 9, 10, the piston 45 is pushed by hydraulic oil in direction of the bore 12 in opposition to its magnetic force towards a stop sleeve 46 which is centrally supported in the bore 11 of the circular base section 3. Preceding the piston 45 in radial direction in the bore 12 is a further permanent-magnetic body 47 which exerts a repulsive force with respect to the piston 45.

FIG. 7 shows a further variation of the magnetic locking mechanism. A piston 48 which is longitudinally moveable in the bores 11, 12 is of ferromagnetic, however, non-magnetizable configuration. In case of coupling, this piston 48 is shifted towards the bore 12 by hydraulic oil in opposition to the magnetic force of a permanent magnet 49 which is received centrally in the bore 11. A stop member 37*a* limits the radial displacement.

Figure 8:
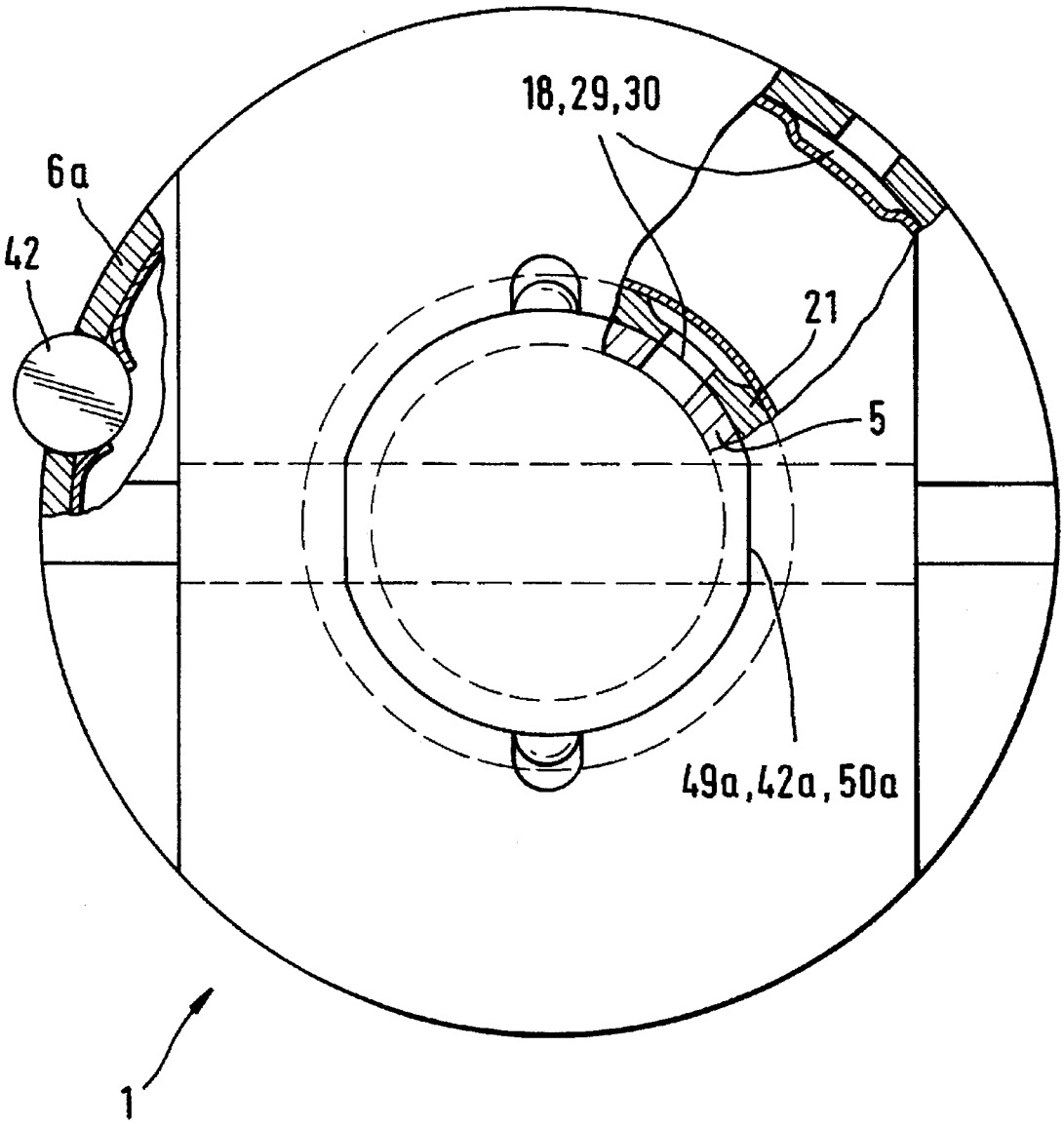
FIG. 8 is a plan view upon a tappet according to the invention with safety mechanism to prevent rotation of the units relative to each other.

As can be seen from FIG. 8, an outer peripheral surface 49*a* of the guide sleeve 5 and the bore 42*a* of the concentric prolongation 21 exhibit mutually complementary flattened areas 50*a* for providing a safety mechanism to prevent rotation of the two elements 2, 3 relative to each other.

Figure 9:
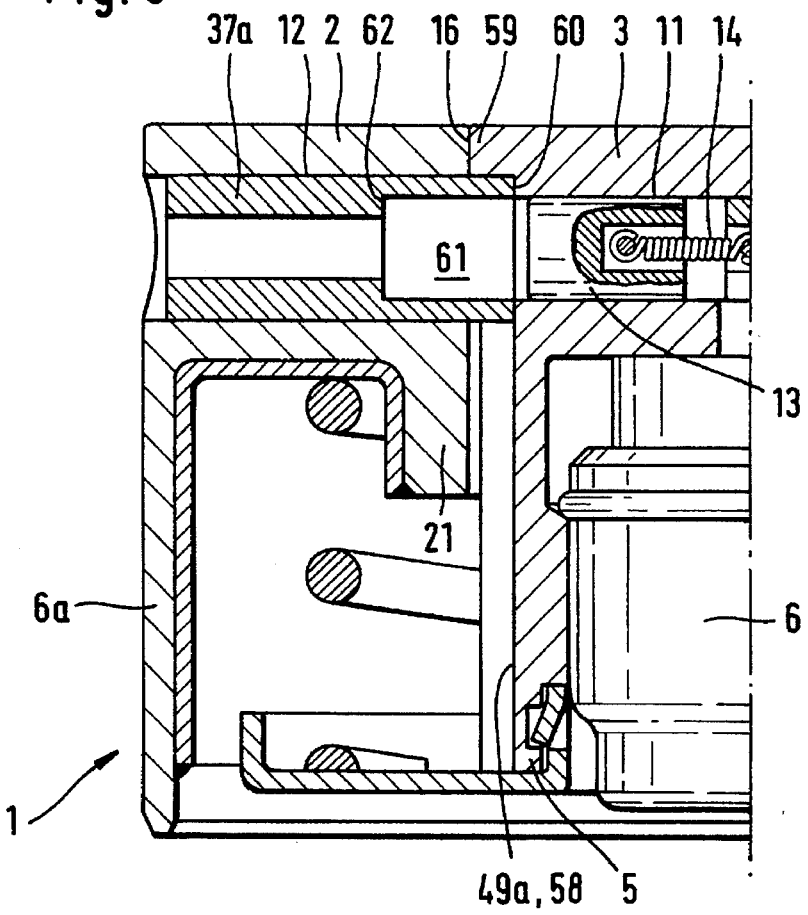
FIG. 9 is a view of a tappet according to the invention with an alternative variation of a safety mechanism to prevent rotation of both sections relative to each other.
Figure 10:
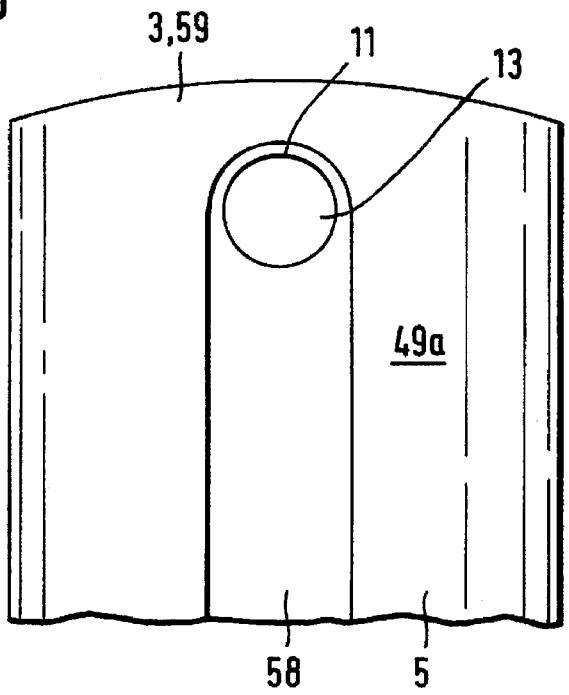
FIG. 10 is a front view of the circular base section, with its guide sleeve in the region of its flattened area.

Finally, FIGS. 9 and 10 show an alternative variation of a safety mechanism to prevent rotation of the two elements 2, 3 as compared with the previously described embodiments. The guide sleeve 5 of the circular base section 3 now includes a flattened area 58 which terminates immediately in front of the base section 3. The immediate base section 3 bears however with a collar 59 of a diameter corresponding to the original diameter of the circular ring shaped base section 3 against the original partition plane 16 between both elements 2, 3. Received in the bore 12 of the circular ring shaped base section 2 is a stop member 37*a* that is configured as sleeve. This stop member 37*a* extends radially inwards up to the flattened area 58. Thus, in a simple fashion, the stop member 37*a* which beam with its end face 60 against the flattened area 58 effects a safety mechanism to prevent rotation of both elements 2, 3 relative to each other and at the same time limits the axial displacement of the circular ring shaped base section 2 relative to the circular base section 3. The stop position is effected in a base circle of the control cam in which both bores 11, 12 of the circular and circular ring shaped base sections 3, 2 are aligned with each other. In this position, the piston 13 can be shifted, as described above by hydraulic medium in opposition to the force of its tension spring 14 into a bore 61 which extends from the end face 60 of the stop member 37*a* radially outwards. The displacement of the piston 13 is limited in the bore 61 by the bottom 62 thereof in such a manner that the piston bridges at the same time the partition plane 16 between both elements 2, 3.

We claim:

1. A tappet assembly for a valve actuating mechanism of an internal combustion engine, comprising:

a first tappet member received in a cylinder head and exhibiting a base section formed with a radial bore and acted upon by a first cam of relatively greater stroke than a second cam;

a second tappet member received within the cylinder head concentrically adjacent the first tappet member at formation of an annular partition plane therebetween, said second tappet member being formed with a radial bore and exhibiting a base section actuated upon by the second cam of relatively smaller stroke, said first and second tappet members being moveable relative to each other in response to the first and second cams, with the radial bores being in alignment in a base circle phase of the first and second cams;

a clearance compensation element positioned in the second tappet member; and coupling means for connecting the first and second tappet members with each other, said coupling means including at least one piston moveable between a first position in which the piston is disposed in one of the radial bores of the base sections to disengage the first and second tappet members from one another and a second position in which the piston bridges the partition plane to couple the first and second tappet members with each other.

2. The tappet of claim 1, and further comprising a single fluid passageway means for conducting a pressure fluid to a central fluid reservoir of the clearance compensation element and to the piston for effecting a displacement thereof.

3. The tappet of claim 2 wherein the pressure fluid is hydraulic oil.

4. The tappet of claim 1 wherein the base section of the first tappet member is of circular ring shaped configuration, and the base section of the second tappet member is of circular configuration.

5. The tappet of claim 2 wherein the first tappet member has a sleeve-like concentric prolongation extending from the base section of the first tappet member in a direction facing away from the cam means for receiving a guide sleeve formed on the base section of the second tappet member.

6. The tappet of claim 5 wherein the first tappet member includes a hollow cylindrical jacket connected to the base section of the first tappet member for guidance in the cylinder head, said jacket being formed with an inlet bore for admission of pressure fluid.

7. The tappet of claim 6 wherein the first tappet member defines an annular space which extends radially between the prolongation and the jacket, and further comprising an annular sheet metal part of inverted U-shaped configuration which is received in the annular space to define a fluid reservoir adjacent the base section of the first tappet member and bears with its sides against inner peripheral surfaces of the jacket and the prolongation in an oiltight and airtight manner, said fluid passageway means being formed by a first passageway extending between the inner peripheral surface of the jacket and the opposing side of the U-shaped sheet metal part and a second passageway extending between the inner peripheral surface of the prolongation and the opposing side of the U-shaped sheet metal part, said first and second passageways connecting the inlet bore of the jacket with the fluid reservoir in the first tappet member and said fluid reservoir via at least one pair of aligned bores of the prolongation and the guide sleeve with the central fluid reservoir of the clearance compensation element and with the piston.

8. The tappet of claim 2 wherein the clearance compensation element has an outer piston, an inner piston supported within the outer piston and exhibiting a cam-proximal end face, and a plate-shaped insert secured onto the cam-proximal end face of the inner piston and positioned at a distance from an opposing inner end face of the base section of the second tappet member to define at least one radial channel which forms part of the fluid passageway means for allowing pressure fluid to act on the piston, said inner piston being formed with at least one opening adjacent the insert for allowing passage of pressure fluid into the central oil reservoir.

9. The tappet of claim 1 wherein the coupling means includes a tension spring for loading the piston to seek the first position, and a pin arranged centrally in the base section of the second tappet member, said tension spring having one end secured to the piston and another end attached to the pin.

10. The tappet of claim 1 wherein the coupling means includes stop members provided in the radial bore of the base section of the first tappet member for limiting a radial displacement of the piston.

11. The tappet of claim 1 wherein the base section of the second tappet member is formed with a number of radial bores which are arranged in star-shaped configuration, said at least one piston including a corresponding number of pistons respectively received in the radial bores of the second tappet member, said coupling means including ring segments acting upon the pistons and a spring element bracing the ring segments about their outer peripheral surface and loading the ring segments radially inwardly so that the pistons are urged into the first position.

12. The tappet of claim 11 wherein the spring element is formed by at least one tubular spring which is secured in place in an annular groove formed about the outer peripheral surface of the ring segments.

13. The tappet of claim 11 wherein the second tappet member has a sleeve-like prolongation extending from the base section of the second tappet member in a direction facing away from the cam means and exhibiting at least in the region of the ring segments, which project from the radial bores of the base section of the second tappet member in the first position, a diametrical enlargement that forms a lower edge to provide a stop for the ring segments.

14. The tappet of claim 1 wherein the at least one piston is a permanent-magnetic piston, and further comprising a stop sleeve supported centrally in the radial bore of the base section of the second tappet member, said coupling means including a permanent-magnetic body received in the radial bore of the base section of the first tappet member and exerting a repulsive force with respect to the piston so that the piston seeks the first position in the direction of the stop sleeve, said piston being shiftable radially into the second position in opposition to the repulsive force by the pressure fluid for engagement of the first and second tappet members.

15. The tappet of claim 1 wherein the at least one piston is a ferromagnetic, non-magnetizable piston, said coupling means including a permanent-magnet received centrally in the radial bore of the base section of the second tappet member and exerting a magnetic force with respect to the piston so that the piston seeks the first position, said piston being shiftable in radial direction in opposition to the magnetic force by the pressure fluid for engagement of the first and second tappet members.

16. The tappet of claim 1 and further comprising stop means for limiting a relative axial displacement of the first and second tappet members.

17. The tappet of claim 16 wherein the second tappet member has a guide sleeve formed on the base section of the second tappet member and defining an outer peripheral surface, said stop means being arranged in a region of the outer peripheral surface of the guide sleeve near one cam-proximate end face of the base section of the second tappet member, with the stop means being formed by rolling elements which are press-fitted in complementary recesses of the outer peripheral surface of the guide sleeve.

18. The tappet of claim 6, and further comprising a roller needle arranged in the jacket of the first tappet member and projecting radially beyond the jacket for guiding and securing the first and second tappet members against rotation within the cylinder head.

19. The tappet of claim 5 wherein the guide sleeve and the prolongation include axially extending, complementary flattened areas.

20. The tappet of claim 7, and further comprising at least one compression spring arranged in the annular space between the bottom of the U-shaped sheet metal part and a further sheet metal part which extends radially from and surrounds a cam-distal area of the guide sleeve and exerts a spring force in axial direction.

21. The tappet of claim 5 wherein the guide sleeve has an outer peripheral surface formed with at least one axial flattened area which extends in direction of the base section of the second tappet member such that the base section of the second tappet member exhibits a radially projecting collar of a diameter corresponding to a diameter of the outer peripheral surface in immediate cam proximity, and further comprising stop means arranged in the base section of the first tappet member and projecting beyond the collar radially inwards to extend past the partition plane between both base sections and to bear with its inner end face against the flattened area.

22. The tappet of claim 21 wherein the stop means are formed as a sleeve arranged in the radial bore of the base section of the first tappet member and exhibiting on the side of its inner end face a bore defined by a base and engaged by the piston when the piston occupies the second position, with the piston bearing upon the base of the bore.

23. A tappet assembly for a valve actuating mechanism of an internal combustion engine, comprising:

a first tappet member received in a cylinder head and exhibiting a base section acted upon by a first cam of relatively greater stroke than a second cam;

a second tappet member received within the cylinder head concentrically adjacent the first tappet member at formation of an annular partition plane therebetween, said second tappet member exhibiting a base section actuated upon by the second cam of relatively smaller stroke, said first and second tappet members being moveable relative to each other in response to the cam means;

a clearance compensation element positioned in the second tappet member;

a coupling element moveable between a first position in which the first and second tappet members are disengaged from one another and a second position in which the first and second tappet members are coupled with each other; and stop means for limiting a relative axial displacement of the first and second tappet members, wherein the second tappet member has a guide sleeve formed on the base section of the second tappet member and defining an outer peripheral surface, said stop means being arranged in a region of the outer peripheral surface of the guide sleeve near one cam-proximate end face of the base section of the second tappet member, with the stop means being formed by rolling elements which are press-fitted in complementary recesses of the outer peripheral surface of the guide sleeve.

* * * * *